United States Patent [19]

Kartinian

[11] 4,227,389

[45] Oct. 14, 1980

[54] KEY HOLDER

[76] Inventor: Alfred Kartinian, 65 New Rd., Apt. 31, Rumford, R.I. 02916

[21] Appl. No.: 34,939

[22] Filed: Apr. 30, 1979

[51] Int. Cl.[3] ..... A47G 29/10

[52] U.S. Cl. ..... 70/456 R; 70/359

[58] Field of Search ..... 70/456 R, 456 B, 457, 70/458, 459; 24/3 K; 150/40

[56] References Cited

U.S. PATENT DOCUMENTS 4,113,156 9/1978 Brito ..... 24/3 K

FOREIGN PATENT DOCUMENTS 496860 11/1950 Belgium ..... 70/459

604747 9/1960 Canada ..... 70/459

628216 8/1949 United Kingdom ..... 70/459

*Primary Examiner*—Robert L. Wolfe

*Attorney, Agent, or Firm*—Salter & Michaelson

[57] ABSTRACT

A key holder comprising in combination a housing and a ring member, the housing having a resilient tongue which may be depressed so as to provide an opening through which the ring member may be inserted. The ring member is provided with a slit which permits keys to be attached and detached, said slit being inaccessible when the ring member is assembled to the housing, whereupon keys can be attached to or detached from the ring member only when the latter has been separated from the housing.

9 Claims, 7 Drawing Figures

KEY HOLDER

BACKGROUND AND SUMMARY OF THE INVENTION

The present invention relates to a key holder embodying as a part thereof a split ring which may be easily deformed to permit keys to be attached or detached. The problem with key rings of this type and with numerous other existing types of key rings or key chains, is that keys frequently become inadvertantly detached and become lost. In order to overcome this problem, relatively sophisticated types of key rings or key holders have been provided, such as rings having overlapping portions which must be forcibly separated to permit a key to be inserted or removed. The problem with this type of key ring is that it is physically difficult to force the key into the ring and to a somewhat lesser extent forcibly remove the key from the ring.

Other types of key holders heretofore in use comprise cases having pin means that extend through the openings in the heads of the keys, but here again such holders require excessive manipulation to add or remove keys and furthermore, where the pin embodies a screw and nut assembly, keys are frequently lost when the nut or cap becomes inadvertantly separated from the pin.

There is therefore a need for a key holder comprising a rng which permits keys to be easily inserted and removed, but wherein means are provided for preventing the ring from being inadvertantly deformed or separated so as to prevent keys from being accidentally displaced therefrom. This is accomplished in the instant invention by providing a ring member of substantially circular configuration having a bail portion of a substantially rectangular configuration extending integrally therefrom, with the slit or separation in the ring member being located somewhere along the lateral extent of said bail portion. The bail portion is adapted to be swingably received by a housing which comprises as a part thereof a resilient tongue which when depressed, provides an opening through which the bail portion of the ring member may be inserted. Once so inserted, the ring member is swingably connected to the housing and since the lateral extent of the bail portion is no longer exposed, the slit or separation therein is inaccessible for accidental opening. Furthermore, the housing is constructed and configured so that the side walls thereof abut opposite ends of the bail portion so as to prevent spreading of the latter when the ring member is attached to the housing.

It will thus be seen that keys may be easily mounted on the ring member by simply forcing them between the separation therein, after which the ring member, with the keys mounted thereon, may be easily assembled to the housing simply by pressing the bail portion of the ring member downwardly against the resilient tongue of the housing so that the bail portion snaps beneath the adjacent end wall of the housing so as to be maintained in assembled relation with the housing. When so assembled, the keys on the ring member are readily accessible, but the ring member is prevented from being accidentally opened by virtue of its coaction with the housing, and there likewise is virtually no likelihood of the ring member becoming accidentally detached from the housing. However, when it is desired to remove the ring member from the housing, as when it is desirable to add or remove keys, such disassembly may be very simply and easily accomplished by simply depressing the resilient tongue of the housing and removing the ring member through the opening that is provided by such action.

Other objects, features, and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
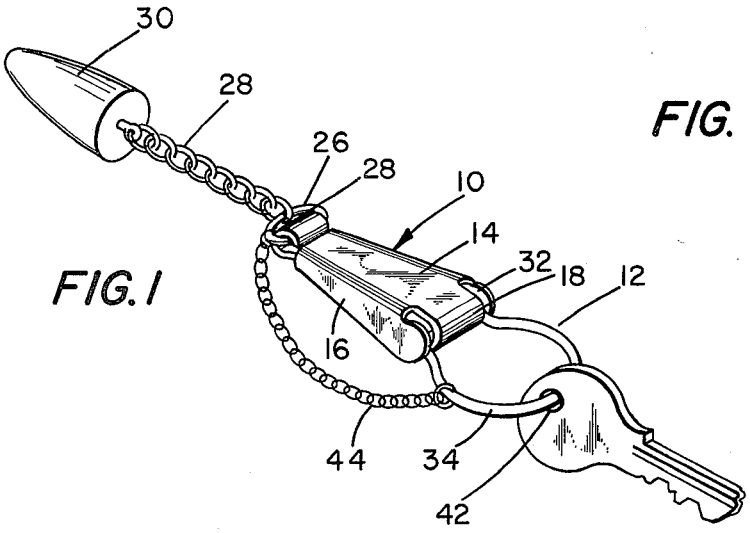
FIG. 1 is a perspective view of a key holder embodying the instant invention.

Referring to the drawing, there is shown a key holder comprising as its essential elements a housing 10 and a ring member 12. The housing 10 is preferably of metallic construction formed from a unitary one-piece blank that has been formed to provide a bottom wall 14, side walls 16, end walls 18, 20, and a top wall 22. As will be noted, end wall 20 comprises a tubular rolled portion which extends integrally from top wall 22 and than rolls around into communication with bottom wall 14 which in turn integrally communicates with end wall 18, which curves around and terminates in overlying relation with respect to depressed lip 24, located at the free extremity of top wall 22. The enclosure is completed by the side wall 16 being upwardly bent so that their top edges abut and align with top wall 22.

Figure 6:
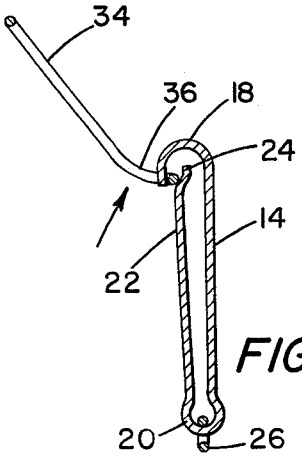
FIG. 6 is a sectional view similar to FIG. 5 showing the ring member in the process of being assembled to the housing.

As previously stated, the housing 10 is preferably of metallic construction, and preferably the metallic material has been spring tempered so that the top wall 22 actually functions as a depressable tongue, it being apparent that when the top wall or tongue 22 is depressed, an opening will present itself between the lip 24 and the terminal edge of end wall 18, as most clearly illustrated in FIG. 6. The tubular rolled end wall 20 functions both as a living hinge for wall 22, and also as an openended channel for receiving a link or hoop 26, to which may be optionally attached a flexible linkage, such as chain 28 which in turn may carry any suitable ornament 30 at its free extremity.

Figure 4:
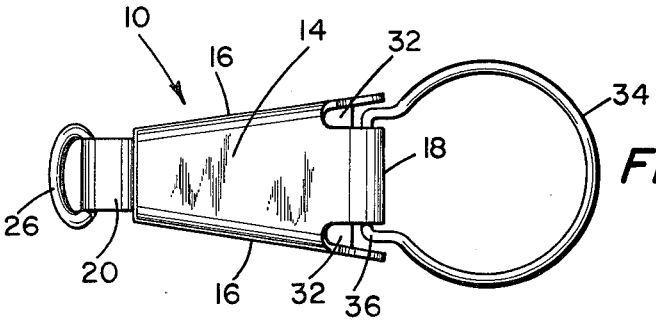
FIG. 4 is a bottom plan view thereof.
Figure 7:
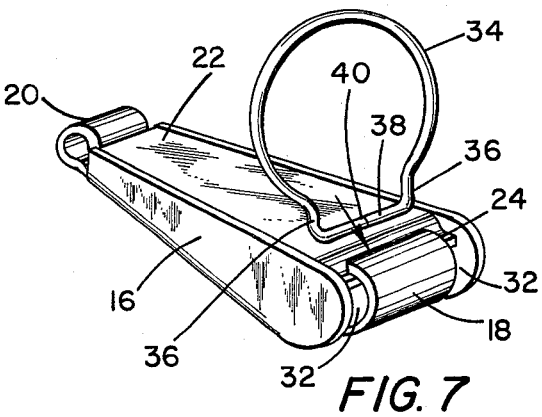
FIG. 7 is a perspective view showing the ring member just prior to being assembled with the housing.

It is important to note that curved end wall 18 is centrally positioned between the adjacent ends of side walls 16 and is inwardly spaced therefrom, so as to define slots 32 on either side of the wall 18. On the top side housing 10 the slots 32 terminate at lip 24, while on the bottom wall 14 for a somewhat appreciable extent, as most clearly illustrated in FIG. 4, and for reasons which will hereinafter become apparent. Although it is not essential to do so, it has been found desirable to have the housing 10 wider than adjacent end 18 whereupon the housing gradually tapers from side to side as it approaches the opposite end 20. Also, as shown most clearly in FIG. 7, end wall 18 snugly interengages with depressed lip 24 so that the outer surface of end wall 18 forms a substantially flush continuation of top wall 22. Obviously the housing 10 may have any suitable ornamentation engraved or otherwise applied thereto.

The ring member 12 comprises a wire ring having a substantially circular portion which has a substantially rectangular bail portion extending therefrom. Specifically, the rectangular bail portion comprises the side portion 36 interconnected by an elongate lateral portion 38 having a slit or separation 40 therein located somewhere between side portions 36. It will be understood that keys may be easily forced onto the ring member 12 simply by forcing the head of the key between the slit or separation 40 until the opening 42 in the head of the key is received by the ring member so as to be slidably positioned thereon. When any desired key or keys have been so inserted onto ring member 12, the ring member is assembled to a housing 10 by forcing the bail portion thereof downwardly against tongue wall 22, as illustrated most clearly in FIGS. 6 and 7, until the bail portion has become captured beneath end wall 18. During such assembly, it will be apparent that the side portions 36 of the ring member extend into and are received by the slots 32 and since the side walls 16 extend at least to the end plane of wall 18, it will be apparent that the end portions of said side walls function as barriers which prevent the ring member from being spread apart to the extent where it can be removed from housing 10 or to the extent where keys can accidentally become dislodged from the ring. Expressed differently, when the ring member 12 has been assembled to housing 10, as aforesaid, the slit or separation 40 is covered by end wall 18 whereupon it is inaccessible for accidental deformation or separation such as would permit keys to be inadvertently detached from the ring. Nor can the bail portion of the ring be spread apart excesssively, because this is prevented by the adjacent end portions of side walls 16. However, when it is desired to remove the ring 12 so as to detach or attach keys with respect thereto, it is simply necessary to depress the tongue or wall 22 and to slidably remove the ring through the opening thereby provided.

Figure 2:
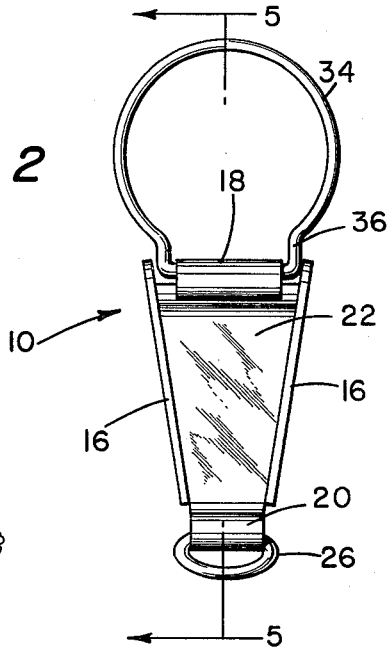
FIG. 2 is a top plan view thereof.

It will be noted that the diameter of circular portion 34 is greater than the maximum width of housing 10. This prevents the ring member 12 from being forced downwardly into the housing (viewing FIG. 2) for any appreciable distance since the upper edges of side walls 16 will engage said circular portion to limit such movement.

Figure 3:
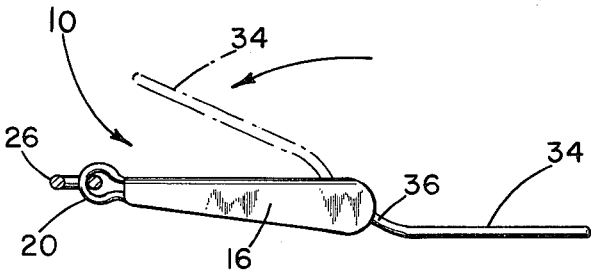
FIG. 3 is a side elevational view thereof.
Figure 5:
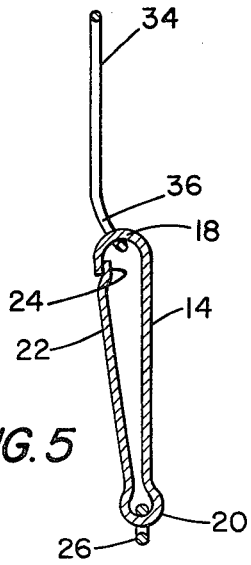
FIG. 5 is a section taken on line 5—5 of FIG. 2.

As will be seen most clearly in FIGS. 5 and 6, the plane of circular portion 34 is off-set or angularly disposed with respect to the plane of the bail portion which extends therefrom. This angulation, in combination with the elongation of slots 32 in bottom wall 14, permit the ring member to be swung rearwardly, as illustrated in FIG. 3, to a point where the circular portion 34 lies substantially flat against bottom wall 14. It will be obvious that without the aforesaid angulation, and without the extension of slots 32 in bottom wall 14, it would not be possible for the ring member to be swung to a position where it lies substantially flat against wall 14.

It may also be desirable to provide an additional flexible linkage, such as chain or the like, shown at 44 in FIG. 1, interconnecting link or hoop 26 with ring member 12. Thus, when the ring member 12 has been separated from housing 10, it remains flexibly connected to the assembly by means of the linkage 44, thus preventing accidental loss or displacement thereof.

Also, the flexible linkage 44 may be used to encircle a wearer's belt if it is desired to attach the key holder to one's person.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims. For example, although the ring member 12 has been shown as being substantially circular, it will be understood that other configurations could be employed, so long as the lateral dimension of same is greater than the width of housing 10 so as to restrict excessive inward movement of the member 12 toward housing 10. Also, the specific shape and configuration of housing 10 may be varied so long as the releasable lock between member 12 and housing 10 remains unaffected.

What is claimed is:

1. A key holder comprising a housing having a bottom wall, side and end walls, and a top wall, said top wall comprising a resilient tongue normally in abutting relation to one of said end walls but adapted to be depressed to a second position wherein an opening is provided between said tongue and said one end wall, said one end wall being positioned between said side walls in spaced relation thereto so as to define slots on opposite sides of said one end wall, and a ring member comprising a first portion having a lateral dimension greater than the distance between said side walls, and a generally rectangular shaped second portion being dimensioned so as to extend through said slots beneath said one end wall, said ring member being readily releasable from said housing by depressing said tongue and removing said rectangular portion through the aforesaid opening provided thereby, said rectangular portion having a slit extending therethrough for permitting keys to be attached and detached, said slit being covered by said one end wall when said ring member is attached to said housing whereby keys can only be attached to and detached from said ring member after the latter has been separated from said housing.

2. In the key holder of claim 1, said tongue having a downwardly depressed lip at its free extremity, said one end wall comprising an integral extension of said bottom wall which curves around the end of said housing and terminates in snug interengagement with said depressed lip.

3. In the key holder of claim 2, said other end wall extending beyond said walls and defining a laterally extending open-ended tubular channel, and a link member extending through said channel adapted to have a chain or the like connected thereto for supporting an ornament.

4. In the key holder of claim 3, flexible means connecting said link member to said ring member whereby when the latter is separated from said housing, it remains flexibly attached thereto.

5. In the key holder of claim 1, said housing being of integral one-piece metallic construction.

6. In the key holder of claim 1, said side walls extending at least as far as said one end wall, whereby when said ring member is attached to said housing, said side walls prevent spreading of said rectangular portion.

7. In the key holder of claim 1, said slots extending partially into said bottom wall, the plane of said rectangular portion being angularly disposed with respect to the plane of said first portion, whereby when said ring member is swung toward said bottom wall, it may lie substantially flat thereagainst.

8. In the key holder of claim 3, said housing being wider at said one end, said side, top, and bottom walls gradually tapering toward said other end.

9. In the key holder of claim 1, said ring member first portion being of substantially circular configuration.

* * * * *